US011480114B2

(12) United States Patent
Okoshi et al.

(10) Patent No.: US 11,480,114 B2
(45) Date of Patent: Oct. 25, 2022

(54) CONTROL APPARATUS

(71) Applicant: HONDA MOTOR CO., LTD., Tokyo (JP)

(72) Inventors: Satoru Okoshi, Tokyo (JP); Yuichiro Fukazawa, Tokyo (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 17/197,143

(22) Filed: Mar. 10, 2021

(65) Prior Publication Data

US 2021/0340917 A1 Nov. 4, 2021

(30) Foreign Application Priority Data

Apr. 30, 2020 (JP) ..... JP2020-080652

(51) Int. Cl.
*F02D 9/00* (2006.01)
*F02D 9/02* (2006.01)

(52) U.S. Cl.
CPC ..... *F02D 9/02* (2013.01); *F02D 2009/0213* (2013.01)

(58) Field of Classification Search
CPC . F02D 9/02; F02D 11/02; F02D 11/10; F02D 2009/0294
See application file for complete search history.

(56) References Cited

U.S. PATENT DOCUMENTS 5,541,844 A * 7/1996 Ibaraki ..... F02D 41/2409 701/101
8,068,944 B2 * 11/2011 Tanaka ..... F02D 11/105 701/4
8,406,981 B2 * 3/2013 Tetsuka ..... F02D 9/02 123/403
9,341,125 B2 * 5/2016 Goho ..... F02D 11/105
2005/0153816 A1 * 7/2005 Yoda ..... F02D 11/02 477/203

(Continued)

FOREIGN PATENT DOCUMENTS

JP 2001-073840 A 3/2001
JP 2010223134 A 10/2010

OTHER PUBLICATIONS

Japanese Office Action for Japanese Patent Application No. 2020-080652 dated Nov. 6, 2021 (partially translated).

*Primary Examiner* — Phutthiwat Wongwian
*Assistant Examiner* — Sherman D Manley
(74) *Attorney, Agent, or Firm* — Thomas | Horstemeyer, LLP

(57) ABSTRACT

A control apparatus includes a throttle configured to adjust an amount of air flowing in an intake passage of an engine, an accelerator opening sensor configured to detect an accelerator opening, a throttle opening sensor configured to detect an opening of the throttle, and a control unit configured to control the opening of the throttle. The control unit includes a setting unit configured to set a target opening and set a control amount of the throttle based on a deviation between the target opening and the opening detected by the throttle opening sensor, and a correction unit configured to, if the target opening is not more than a predetermined opening, set a correction amount of the control amount such that the opening of the throttle becomes large independently of the deviation.

6 Claims, 5 Drawing Sheets

(56) References Cited

U.S. PATENT DOCUMENTS

| | | | | |
|---|---|---|---|---|
| 2005/0155571 | A1* | 7/2005 | Hanasato | F02D 9/1095 123/336 |
| 2005/0247287 | A1* | 11/2005 | Kondo | F02M 35/10255 123/337 |
| 2007/0119419 | A1* | 5/2007 | Matsuda | F02D 9/08 123/403 |
| 2007/0169743 | A1* | 7/2007 | Kobayashi | F02D 11/10 123/352 |
| 2010/0126299 | A1* | 5/2010 | Baldassari | F02D 11/10 74/491 |
| 2010/0250094 | A1 | 9/2010 | Tetsuka et al. | |
| 2011/0048373 | A1* | 3/2011 | Okoshi | F02D 31/003 123/399 |
| 2012/0266717 | A1* | 10/2012 | Sakai | F02D 11/10 74/551.9 |
| 2013/0075640 | A1* | 3/2013 | Grossmann | F16K 37/0083 73/114.77 |
| 2014/0303809 | A1* | 10/2014 | Bamba | F02D 11/10 701/2 |
| 2018/0079465 | A1* | 3/2018 | Tetsuka | F02D 11/02 |
| 2018/0202372 | A1* | 7/2018 | Doyama | F02D 41/0002 |
| 2020/0148207 | A1* | 5/2020 | Fukazawa | F02D 41/10 |

* cited by examiner

CONTROL APPARATUS

CROSS-REFERENCE TO RELATED APPLICATION(S)

This application claims priority to and the benefit of Japanese Patent Application No. 2020-080652 filed on Apr. 30, 2020, the entire disclosure of which is incorporated herein by reference.

BACKGROUND OF THE INVENTION

Field of the Invention

The present invention relates to throttle control of an engine.

Description of the Related Art

There is known a control apparatus of a throttle-by-wire type, which detects an accelerator opening by a sensor and electronically controls the throttle opening of an engine (for example, Japanese Patent Laid-Open No. 2001-73840).

In a region where the throttle opening is small, since the intake pressure of the engine strongly acts on a throttle valve, the distortion of a throttle shaft caused by the intake pressure may become large. Since the distortion of the throttle shaft becomes a resistive element for the pivotal motion of the throttle shaft, the followability of the throttle to the accelerator operation may lower.

SUMMARY OF THE INVENTION

It is an object of the present invention to improve the followability of a throttle to an accelerator operation in a region where a throttle opening is small.

According to an aspect of the present invention, there is provided a control apparatus comprising: a throttle configured to adjust an amount of air flowing in an intake passage of an engine; an accelerator opening sensor configured to detect an accelerator opening; a throttle opening sensor configured to detect an opening of the throttle; and a control unit configured to control the opening of the throttle, wherein the control unit includes: a setting unit configured to set a target opening based on a detection result of the accelerator opening sensor and set a control amount of the throttle based on a deviation between the target opening and the opening detected by the throttle opening sensor; and a correction unit configured to, if the target opening is not more than a predetermined opening, set a correction amount of the control amount such that the opening of the throttle becomes large independently of the deviation.

Further features of the present invention will become apparent from the following description of exemplary embodiments (with reference to the attached drawings).

DESCRIPTION OF THE EMBODIMENTS

Figure 1:
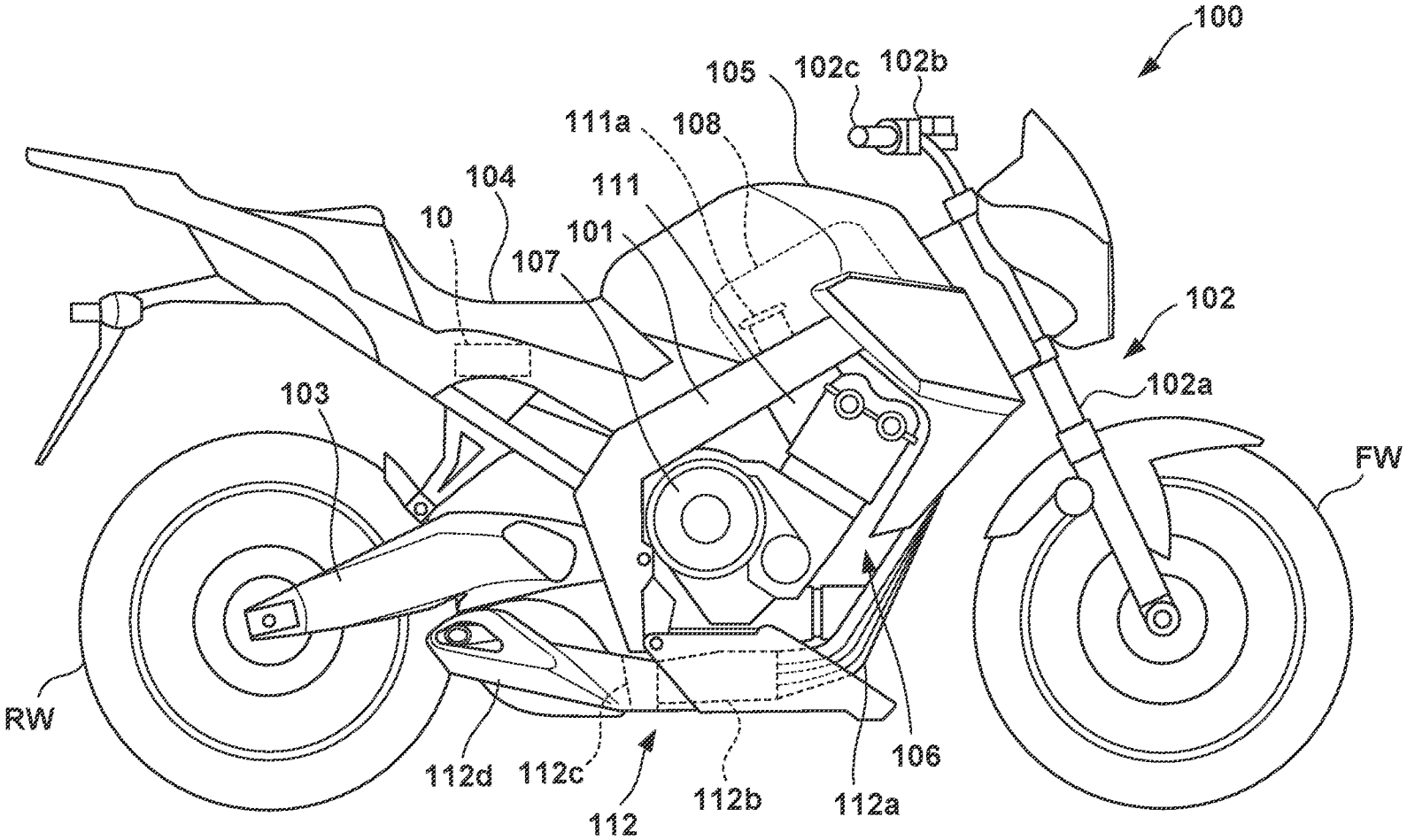
FIG. 1 is a side view of a vehicle as an application example of a control apparatus according to the present invention.

Hereinafter, embodiments will be described in detail with reference to the attached drawings. Note that the following embodiments are not intended to limit the scope of the claimed invention, and limitation is not made an invention that requires all combinations of features described in the embodiments. Two or more of the multiple features described in the embodiments may be combined as appropriate. Furthermore, the same reference numerals are given to the same or similar configurations, and redundant description thereof is omitted.

<Arrangement of Vehicle>

FIG. 1 shows an example of a vehicle to which a control apparatus according to the present invention can be applied and, more particularly, shows a side view (right side view) of a straddle type vehicle 100. As the vehicle 100 according to this embodiment, a motorcycle including a front wheel FW and a rear wheel RW will be exemplified. However, the present invention can also be applied to a vehicle of another type.

The vehicle 100 includes a vehicle body frame 101 that forms the skeleton of the vehicle. A front wheel steering portion 102 is supported at the front end of the vehicle body frame 101, and a swing arm 103 is swingably supported at the rear end. The front wheel steering portion 102 includes a pair of left and right front forks 102*a* that support the front wheel FW, and a steering handle 102*b* attached to the upper portions of the pair of front forks 102*a*. An accelerator grip 102*c* that accepts an acceleration operation of a rider is provided at the right end portion of the steering handle 102*b*. The front end of the swing arm 103 is swingably supported by the vehicle body frame 101, and the rear wheel RW is supported at the rear end of the swing arm 103.

In a region between the front wheel FW and the rear wheel RW, an engine 106 and a transmission 107 are supported on the vehicle body frame 101. The engine 106 is a 4-stroke engine with parallel four cylinders, and includes a crank case, a cylinder block, and a cylinder head. The engine 106 takes in air via an intake passage 111. An exhaust gas after combustion is discharged from an exhaust passage 112. The exhaust passage 112 includes an exhaust pipe 112*a* connected to an exhaust port in correspondence with each cylinder, a collecting portion 112*b* that causes the exhaust pipes 112*a* to merge, a three-way catalyst 112*c*, and a muffler 112*d*. The output of the engine 106 is transmitted to the rear wheel RW via the transmission 107 and a chain transmission mechanism (not shown).

A fuel tank 105 is arranged above the engine 106, and a seat 104 on which the rider sits is arranged on the rear side of the fuel tank 105. An air cleaner box 108 that introduces outside air is arranged inside the fuel tank 105. An air cleaner (not shown) and an air funnel 111*a* that constitutes the intake passage 111 are arranged in the internal space of the air cleaner box 108. The air filtered by the air cleaner can be introduced into the engine 106 via the air funnel 111*a*. On the lower side of the seat 104, a control unit 10 is supported by the vehicle body frame 101.

<Control Apparatus>

Figure 2:
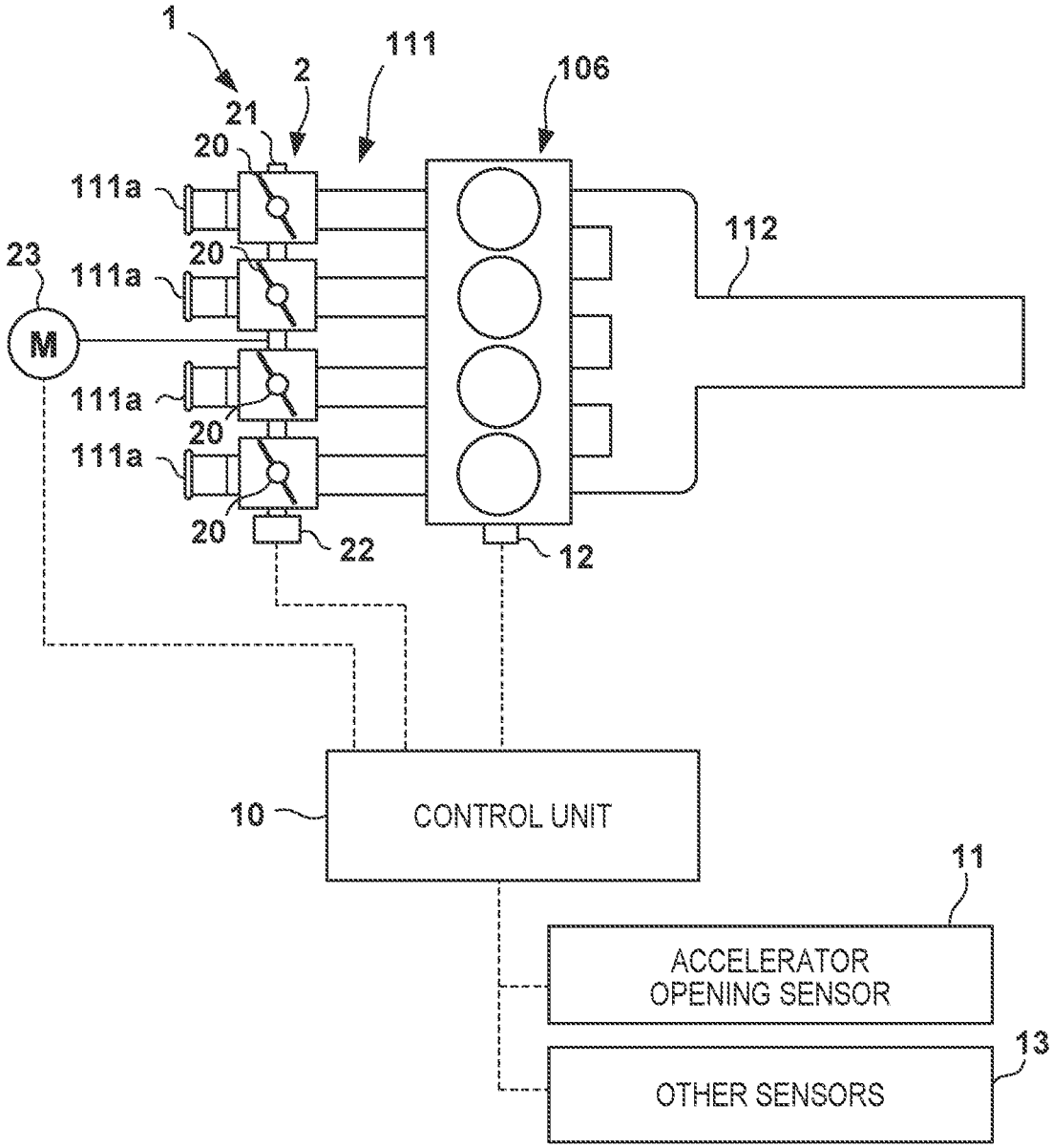
FIG. 2 is a block diagram of the control apparatus according to an embodiment of the present invention.

FIG. 2 is a block diagram of the control apparatus 1 of the engine 106, and particularly shows an arrangement concerning control of a throttle 2. The intake passage 111 includes the air funnel 111*a* provided for each cylinder, and an electronically controlled type throttle 2 is provided in the intake passage 111. The throttle 2 includes a throttle valve (a butterfly valve in this embodiment) 20 for each cylinder, and adjusts the amount of air flowing into each combustion chamber of the engine 106 by the opening of the throttle valve 20. The throttle valves 20 are supported by one common throttle shaft 21.

The throttle shaft 21 is made to pivot by an actuator 23, and the opening of each throttle valve 20 is thus changed. In this embodiment, the actuator 23 is a motor. The opening of the throttle valve 20 is detected by a throttle opening sensor 22 that detects the rotation amount of the throttle shaft 21. The throttle opening sensor 22 is, for example, a rotary encoder. The rotation speed of the engine 106 is detected by a rotation speed sensor 12. The rotation speed sensor 12 is, for example, a crank angle sensor that detects the crank angle of the engine 106, and is a magnetic sensor or an optical sensor.

An accelerator opening sensor 11 is a sensor that detects an accelerator opening. In this embodiment, the accelerator opening sensor 11 is an angle sensor that detects the rotation angle of the accelerator grip 102*c*. The angle sensor is, for example, a variable resistor. Other sensors 13 include a sensor that detects the vehicle speed of the vehicle 100, an inertial sensor that detects the acceleration or angular velocity of the vehicle 100, and the like.

The control apparatus 1 includes the control unit (ECU) 10. The control unit 10 includes a processor represented by a CPU, a storage device such as a semiconductor memory, an input/output interface to an external device, a driving circuit for the actuator 23, and the like. The storage device stores programs to be executed by the processor and data to be used by the processor for processing. Based on the detection result of the accelerator opening sensor 11, the control unit 10 drives the actuator 23, and controls the opening of the throttle valve 20 (throttle by wire).

<Bearing Structure>

Figure 3A:
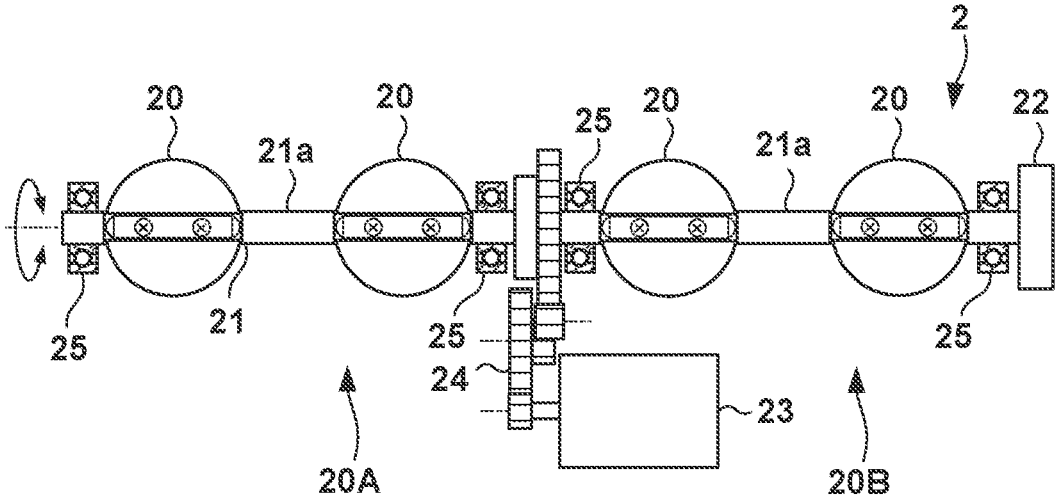
FIG. 3A is an explanatory view of the mechanism of a throttle.

The bearing structure of the throttle shaft 21 will be described. FIG. 3A is an explanatory view of the mechanism of the throttle 2. The throttle shaft 21 is supported by a plurality of bearings 25 to be rotatable about the axis. In this embodiment, the throttle shaft 21 is supported by a total of four bearings 25. The output of the actuator 23 is input to the center portion of the throttle shaft 21 in the axial direction via a gear device 24.

Here, the four throttle valves 20 are divided into sets of two throttle valves 20 on both sides of the gear device 24 and formally separated to a set 20A and a set 20B. On both sides of the set 20A, the throttle shaft 21 is supported by the bearings 25. In other words, two throttle valves 20 of the set 20A are arranged between the two bearings 25. However, a bearing that supports the throttle shaft 21 is not provided in a region 21*a* between the two throttle valves 20 of the set 20A. This also applies to the set 20B. This arrangement contributes to cost reduction from the viewpoint of decreasing the number of bearings. However, the throttle shaft 21 tends to readily deflect.

Figure 3B:
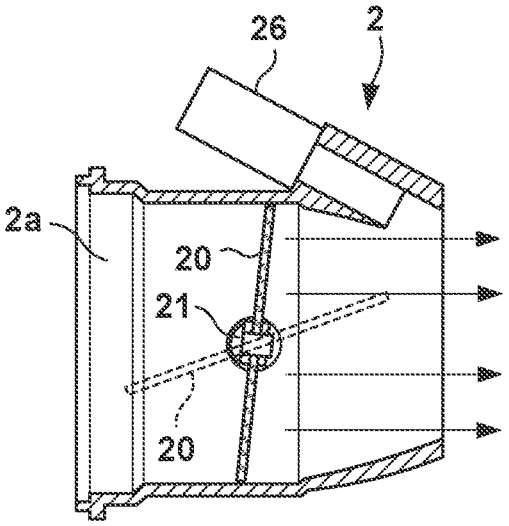
FIG. 3B is an explanatory view of the operation of a throttle valve.

FIG. 3B is a schematic view showing the operation of the throttle valve 20, and is a sectional view of the throttle 2. The throttle 2 includes an intake passage 2*a* for each cylinder, and the throttle valve 20 opens/closes the intake passage 2*a*. In FIG. 3B, the throttle valve 20 indicated by a solid line shows an almost fully closed state, and the throttle valve 20 indicated by a broken line shows an almost fully open state. Arrows indicate the flowing direction of intake air, and an injector 26 is a device that injects a fuel.

Figure 3C:
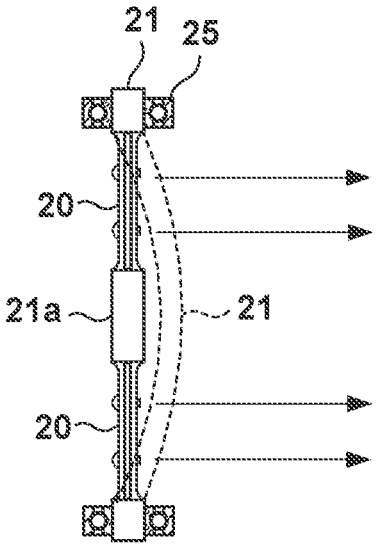
FIG. 3C is a schematic view showing an example of a deflection of a throttle shaft.

A force that pulls the throttle valve 20 to the side of the combustion chamber acts on the throttle valve 20 due to the negative pressure in the cylinder. The smaller the opening is, the larger the pulling force is. As a result, deflection occurs in the throttle shaft 21. FIG. 3C is a schematic view showing this state exaggeratedly. Arrows indicate the flowing direction of intake air. The throttle shaft 21 indicated by a solid line shows a state without deflection, and the throttle shaft 21 indicated by a broken line shows a state in which deflection has occurred. Such deflection of the throttle shaft 21 more conspicuously occurs in an arrangement in which a bearing is not provided in the region 21*a* between the adjacent throttle valves 20, as in this embodiment.

If the throttle shaft 21 deflects, as shown in FIG. 3C, the distortion becomes a resistive element for the pivotal motion by the actuator 23, and a case in which the target opening of the throttle valve 20 in control cannot quickly be obtained (deterioration of a control response) may occur. The rider sometimes feels that the response of the engine 106 is bad. In this embodiment, this is improved by control to be described below.

<Throttle Control>

Figure 4:
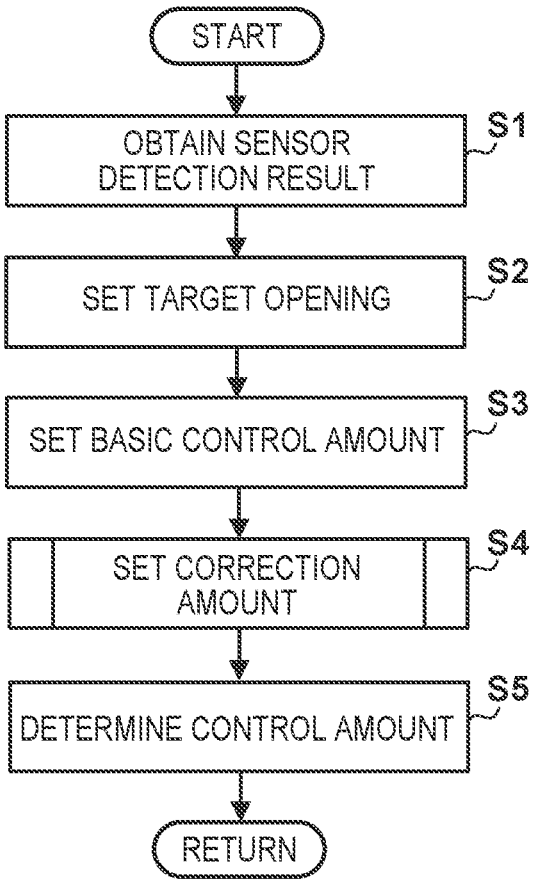
FIG. 4 is a flowchart showing an example of processing of the control apparatus shown in FIG. 2.

Opening control of the throttle 2 will be described with reference to FIG. 4. FIG. 4 is a flowchart showing an example of processing executed by the control unit 10. The control unit 10 repetitively executes the processing shown in FIG. 4. In step S1, the detection results of the sensors are acquired. In this embodiment, the detection results of at least the accelerator opening sensor 11, the throttle opening sensor 22, and the rotation speed sensor 12 are acquired.

In step S2, the target opening of the throttle valve 20 is set based on the detection results acquired in step S1. In this embodiment, basically, the opening of the throttle valve 20 is set in proportion of the accelerator opening, and an opening corresponding to the opening of the accelerator opening sensor 11 is set as the target opening. However, the target opening can be adjusted in accordance with the driving state of the engine 106 or the traveling state of the vehicle 100.

In step S3, a basic control amount used to make the opening of the throttle valve 20 match the target opening set in step S2 is set. Here, the control amount is set based on the deviation between the target opening set in step S2 and the opening (actual opening) of the throttle valve 20 detected by the throttle opening sensor 22 and acquired in step S1. For example, control amount=coefficient×deviation is set. That is, feedback control is performed. The coefficient can be set in accordance with the driving state of the engine 106 or the traveling state of the vehicle 100.

In step S4, a correction amount is set. Here, a control amount to be added to the basic control amount set in step S3 to improve the control response deteriorated by the deflection of the throttle shaft 21 in a region where the opening of the throttle valve 20 is small is set as the correction amount. The correction amount is set independently of the deviation between the target opening and the actual opening of the throttle valve 20. That is, feedforward control is performed. Details will be described later.

In step S5, a control amount for the throttle 2, that is, a control amount for the actuator 23 is determined. Here, the correction amount set in step S4 is added to the basic control amount set in step S3, thereby obtaining a final control amount. Control of the actuator 23 can be performed by, for example, PWM control. In this case, a duty ratio is decided for the control amount determined in step S5. The larger the control amount is, the larger the duty ratio is, and the larger the output of the actuator 23 is.

Figure 5:
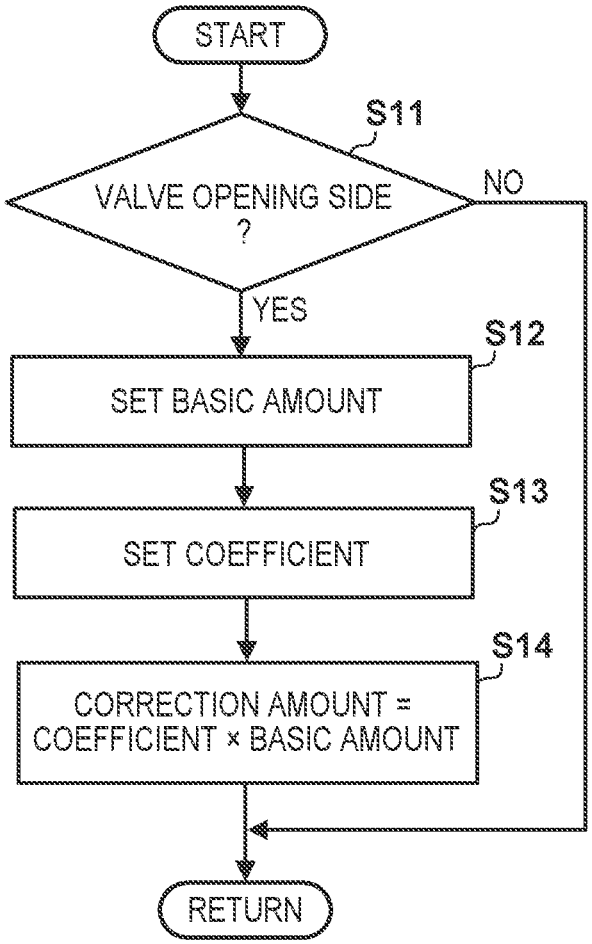
FIG. 5 is a flowchart showing an example of processing of the control apparatus shown in FIG. 2.

FIG. 5 is a flowchart showing the contents of correction amount setting processing in step S4. In step S11, it is determined whether the detection result of the accelerator opening sensor 11 acquired in step S1 represents an opening change on the valve opening side. This determination is determination of whether the rider has operated the accelerator grip 102*c* in the opening direction. For example, let θn be the accelerator opening acquired in step S1 in the current processing, and θn−1 be the accelerator opening acquired in step S1 in the preceding processing. If θn−(θn−1)>0, it is determined that a change is on the valve opening side. Upon determining in step S11 that the detection result represents an opening change on the valve opening side, the process advances to step S12. Otherwise, the processing is ended. In this embodiment, if the opening change is on the valve opening side, no correction amount is added.

Figure 6A:
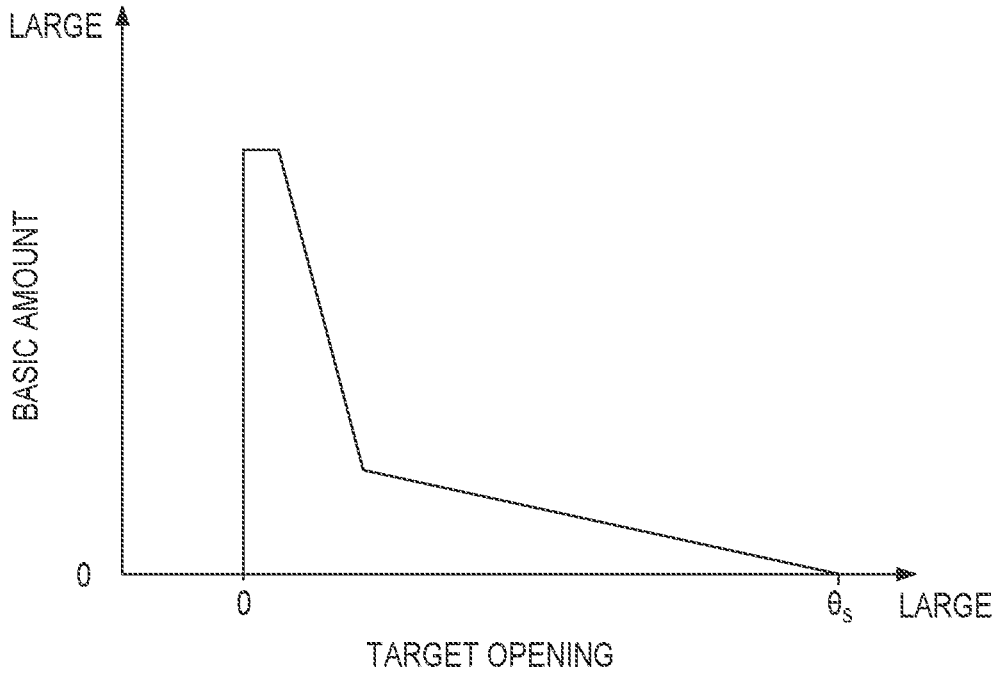
FIGS. 6A and 6B are explanatory views of a correction amount setting method.

In this embodiment, correction amount=coefficient×basic amount is set. In step S12, the basic amount of the correction amount is set. FIG. 6A is an explanatory view showing an example of the basic amount setting method. In the example shown in FIG. 6A, the basic amount is set based on the target opening set in step S2. The section of the target opening for which the basic amount is set is a section from an opening 0 to an opening θs. The opening θs is an opening within the range of, for example, 3° to 7°. The range of the target opening for which the correction amount is set is limited to a small opening region. This is because if the opening of the throttle valve 20 is large, the deflection of the throttle shaft 21 caused by a negative pressure hardly occurs.

In the example shown in FIG. 6A, the basic amount tends to become smaller along with an increase in the target opening. Except near the opening 0, the basic amount for a certain target opening is larger than the basic amount for another target opening larger than the target opening. As the opening of the throttle valve 20 becomes close to the fully closed state, the correction amount becomes large, and the deterioration of the response can be improved in accordance with the degree of deflection of the throttle shaft 21. In particular, in the region (for example, within the range of 0° to 0.5°) where the opening of the throttle valve 20 is close to the fully closed state, the basic amount is set large. In an opening region where the deflection of the throttle shaft 21 is estimated to be large, the deterioration of the response can be improved.

Figure 6B:
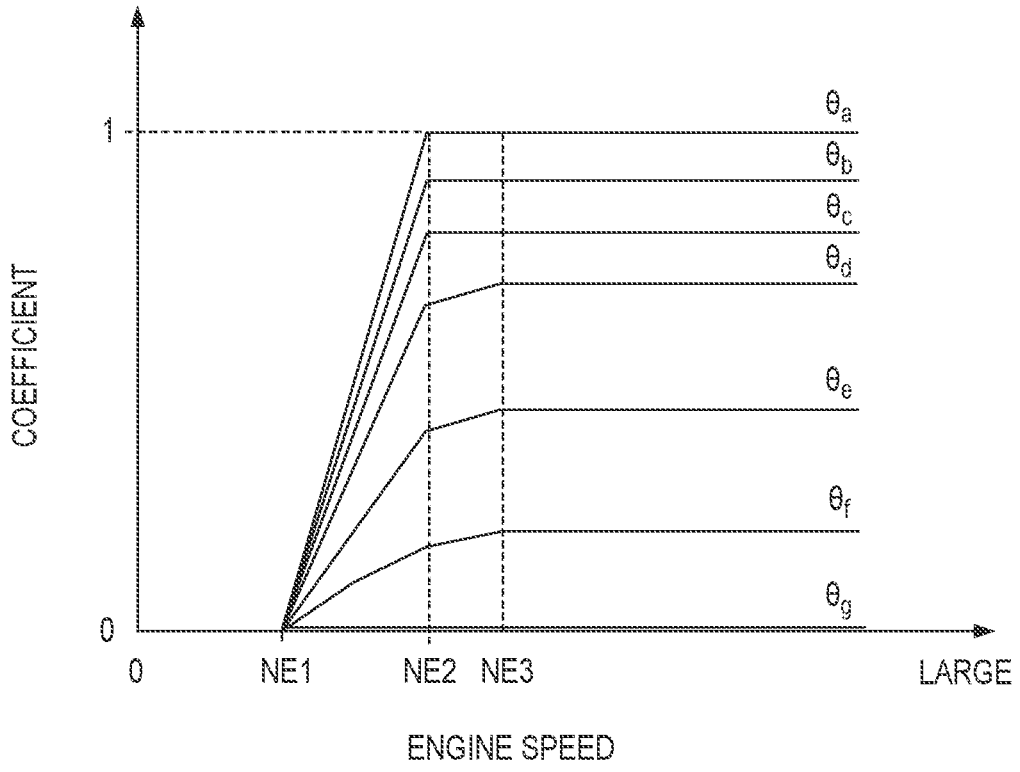

Referring back to FIG. 5, in step S13, the coefficient of the correction amount is set. FIG. 6B is an explanatory view showing an example of the coefficient setting method. In the example shown in FIG. 6B, a coefficient is set within the range of 0 to 1 in accordance with the rotation speed of the engine 106 and the actual opening of the throttle valve 20, whose detection results are acquired in step S1. As the actual opening, θa to θg are shown. The magnitude relationship is given by θa>θb>θc>θd>θe>θf>θg. θa is an opening within the range of, for example, 0.5° to 1.5°, and θg is an opening within the range of, for example, 4.5° to 5.5°. In the case of θg, the coefficient is 0 independently of the rotation speed of the engine 106. If the actual opening of the throttle valve 20 is equal to or larger than θg, the correction amount is 0.

Note that the actual openings θa to θg shown in FIG. 6B are merely examples. The discrimination of actual openings is not limited to this, and an intermediate opening and a coefficient may be associated. More specifically, if the actual opening of the throttle valve 20 is an opening between θa and θb, the same coefficient as the coefficient for θa may be set, or a coefficient having a value between the coefficient for θa and the coefficient for θb may be set in accordance with the actual opening. This also applies to other cases such as a case in which the actual opening of the throttle valve 20 is an opening between θb and θc. As the method of specifying the coefficient, map data may be held, or an arithmetic expression may be held.

In the example shown in FIG. 6B, the coefficient tends to become smaller along with an increase in the actual opening of the throttle valve 20 detected by the throttle opening sensor 22. The coefficient for a certain actual opening is larger than the coefficient for another actual opening larger than the actual opening. As the opening of the throttle valve 20 becomes close to the fully closed state, the correction amount becomes large, and the deterioration of the response can be improved in accordance with the degree of deflection of the throttle shaft 21.

In the example shown in FIG. 6B, for the same actual opening of the throttle valve 20 detected by the throttle opening sensor 22, the coefficient tends to become larger along with an increase in the rotation speed of the engine 106 and then become constant. For example, concerning the actual openings θa to θc, the coefficient increases in proportion to the rotation speed when the rotation speed of the engine 106 ranges from NE1 to NE2, and then holds a predetermined value when the rotation speed exceeds NE2. In addition, concerning the actual openings θd to θf, the coefficient increases in proportion to the rotation speed when the rotation speed of the engine 106 ranges from NE1 to NE2, increases with a different slope in proportion to the rotation speed when the rotation speed of the engine 106 ranges from NE2 to NE3, and then holds a predetermined value when the rotation speed exceeds NE3.

The negative pressure in a cylinder increases in accordance with the engine speed, but changes little at a predetermined rotation speed or more. The range of NE1 to NE2 and the range of NE2 to NE3 are sections where the negative pressure increases in accordance with the engine speed, and it is the range of, for example, several thousands revolutions. At an idling rotation speed, the negative pressure is small. In a region where the engine speed is NE1 or less, the coefficient is 0.

Referring back to FIG. 5, in step S14, the correction amount is set based on the basic amount set in step S12 and the coefficient set in step S13 by correction amount=coefficient×basic amount. When the correction amount is set by feedforward control independently of the deviation between the target opening and the actual opening of the throttle valve 20 in this way, it is possible to improve the followability of the throttle to the accelerator operation in a region where the throttle opening is small.

Summary of Embodiments

The above-described embodiments disclose at least the following control apparatus.

1. A control apparatus according to the above-described embodiment is a control apparatus (1) comprising:

a throttle (2) configured to adjust an amount of air flowing in an intake passage (111) of an engine (106);

an accelerator opening sensor (11) configured to detect an accelerator opening;

a throttle opening sensor (22) configured to detect an opening of the throttle (2); and a control unit (10) configured to control the opening of the throttle, wherein the control unit (10) comprises:

a setting unit (S3) configured to set a target opening based on a detection result of the accelerator opening sensor (11) and set a control amount of the throttle based on a deviation between the target opening and the opening detected by the throttle opening sensor; and a correction unit (S4) configured to, if the target opening is not more than a predetermined opening (θs), set a correction amount of the control amount such that the opening of the throttle becomes large independently of the deviation.

According to this embodiment, it is possible to improve the followability of the throttle to an accelerator operation in a region where the throttle opening is small.

2. In the above-described embodiment, the throttle (2) comprises:

a first throttle valve and a second throttle valve (20);

a throttle shaft (21) configured to support the first and second throttle valves (20);

a first bearing and a second bearing (25) configured to support the throttle shaft (21); and an actuator (23) controlled by the control unit and configured to make the throttle shaft pivot and change openings of the first throttle and the second throttle valve, and the first throttle valve and the second throttle valve (20) are arranged between the first bearing (25) and the second bearing (25), and a bearing configured to support the throttle shaft is not provided between (21*a*) the first throttle valve (20) and the second throttle valve (20).

According to this embodiment, it is possible to improve the followability of the throttle to an accelerator operation in a region where the throttle opening is small in correspondence with a deflection of the throttle shaft caused by a negative pressure while decreasing the number of bearings and reducing the cost.

3. In the above-described embodiment, if the target opening is a first target opening, the correction unit (S4) sets the correction amount larger than the correction amount for a second target opening larger than the first target opening (S12, S14).

According to this embodiment, the correction amount becomes large in a region where the throttle opening is small, and it is possible to improve the followability of the throttle to an accelerator operation.

4. In the above-described embodiment, the control apparatus further comprises a rotation speed sensor (12) configured to detect a rotation speed of the engine (106), wherein if the rotation speed is a first rotation speed, the correction unit (S4) sets the correction amount larger than the correction amount for a second rotation speed smaller than the first rotation speed (S13, S14).

According to this embodiment, the correction amount becomes large in correspondence with an increase in a negative pressure caused by an increase in the engine speed, and it is possible to improve the followability of the throttle to an accelerator operation.

5. In the above-described embodiment, if the opening detected by the throttle opening sensor (22) is a first throttle opening, the correction unit (S4) sets the correction amount larger than the correction amount for a second throttle opening larger than the first throttle opening (S13, S14).

According to this embodiment, the correction amount becomes large in correspondence with an increase in the influence of a negative pressure caused by a small actual opening of the throttle, and it is possible to improve the followability of the throttle to an accelerator operation.

6. The control apparatus according to the above-described embodiment further comprises a rotation speed sensor (12) configured to detect a rotation speed of the engine, wherein the correction unit (S4) sets the correction amount by multiplying a basic amount by a coefficient, the basic amount is set based on the target opening, the coefficient is set based on a detection result of the rotation speed sensor (12) and a detection result of the throttle opening sensor (22), the basic amount tends to become smaller along with an increase in the target opening (FIG. 6A), the coefficient tends to become smaller along with an increase in the opening detected by the throttle opening sensor (FIG. 6B), and for the same opening detected by the throttle opening sensor, the coefficient tends to become larger along with an increase in the rotation speed and then become constant (FIG. 6B).

According to this embodiment, it is possible to set an appropriate correction amount in accordance with the target opening, the actual opening of the throttle, and the rotation speed of the engine, the correction amount become large in a region where the throttle opening is small, and it is possible to improve the followability of the throttle to an accelerator operation.

The invention is not limited to the foregoing embodiments, and various variations/changes are possible within the spirit of the invention.

What is claimed is:

1. A control apparatus comprising:

a throttle configured to adjust an amount of air flowing in an intake passage of an engine;

an accelerator opening sensor configured to detect an accelerator opening;

a throttle opening sensor configured to detect an opening of the throttle; and a control unit configured to control the opening of the throttle, wherein the throttle includes:

a first throttle and a second throttle valve;

a throttle shaft configured to support the first and second throttle valves;

a first bearing and a second bearing configured to support the throttle shaft;

an actuator controlled by the control unit and configured to make the throttle shaft pivot so as to change openings of the first throttle and the second throttle valve; and the first throttle valve and the second throttle valve are arranged between the first bearing and the second bearing, and a bearing configured to support the throttle shaft is not provided between the first throttle valve and the second throttle valve, and wherein the control unit includes:

a setting unit configured to set a target opening of the throttle based on a detection result of the accelerator opening sensor and set a control amount of the throttle based on a deviation between the target opening and the opening detected by the throttle opening sensor; and a correction unit configured to, if the target opening is not more than a predetermined opening, set a correction amount of the control amount such that the opening of the throttle becomes large independently of the deviation.

2. The apparatus according to claim 1, wherein if the target opening is a first target opening, the correction unit sets the correction amount larger than the correction amount for a second target opening larger than the first target opening.

3. The apparatus according to claim 1, further comprising a rotation speed sensor configured to detect a rotation speed of the engine, wherein if the rotation speed is a first rotation speed, the correction unit sets the correction amount larger than the correction amount for a second rotation speed smaller than the first rotation speed.

4. The apparatus according to claim 1, wherein if the opening detected by the throttle opening sensor is a first throttle opening, the correction unit sets the correction amount larger than the correction amount for a second throttle opening larger than the first throttle opening.

5. The apparatus according to claim 1, further comprising a rotation speed sensor configured to detect a rotation speed of the engine, wherein the correction unit sets the correction amount by multiplying a basic amount by a coefficient, the basic amount is set based on the target opening, the coefficient is set based on a detection result of the rotation speed sensor and a detection result of the throttle opening sensor, the basic amount tends to become smaller along with an increase in the target opening, the coefficient tends to become smaller along with an increase in the opening detected by the throttle opening sensor, and for the same opening detected by the throttle opening sensor, the coefficient tends to become larger along with an increase in the rotation speed and then become constant.

6. A control apparatus comprising:

a throttle configured to adjust an amount of air flowing in an intake passage of an engine;

an accelerator opening sensor configured to detect an accelerator opening;

a throttle opening sensor configured to detect an opening of the throttle; and a controller including a processor and a storage device and configured to control the opening of the throttle, wherein the throttle includes:

a first throttle and a second throttle valve;

a throttle shaft configured to support the first and second throttle valves;

a first bearing and a second bearing configured to support the throttle shaft;

an actuator controlled by the control unit and configured to make the throttle shaft pivot so as to change openings of the first throttle and the second throttle valve; and the first throttle valve and the second throttle valve are arranged between the first bearing and the second bearing, and a bearing configured to support the throttle shaft is not provided between the first throttle valve and the second throttle valve, and wherein the storage device stores instruction, that when executed by the processor, causes the controller to:

set a target opening of the throttle based on a detection result of the accelerator opening sensor and set a control amount of the throttle based on a deviation between the target opening and the opening detected by the throttle opening sensor; and set a correction amount of the control amount such that the opening of the throttle becomes large independently of the deviation if the target opening is not more than a predetermined opening.

* * * * *